US005470408A

United States Patent [19]

Nielson et al.

[11] Patent Number: 5,470,408

[45] Date of Patent: Nov. 28, 1995

[54] USE OF CARBON FIBRILS TO ENHANCE BURN RATE OF PYROTECHNICS AND GAS GENERANTS

[75] Inventors: Daniel B. Nielson; Dean M. Lester, both of Brigham City, Utah

[73] Assignee: Thiokol Corporation, Ogden, Utah

[21] Appl. No.: 141,389

[22] Filed: Oct. 22, 1993

[51] Int. Cl.[6] ..... C06B 21/00

[52] U.S. Cl. ..... 149/109.6; 149/2; 149/19.1; 149/108.2

[58] Field of Search ..... 149/2, 19.1, 108.2, 149/109.6

[56] References Cited

U.S. PATENT DOCUMENTS

| | | | |
|---|---|---|---|
| 1,709,870 | 4/1929 | O'Neil . | |
| 2,174,914 | 10/1939 | Crater | 52/11 |
| 3,009,802 | 11/1961 | Lyons | 52/23 |
| 3,369,943 | 2/1968 | Longwell et al. | 149/18 |
| 3,392,068 | 7/1968 | Knowles et al. | 149/21 |
| 3,454,437 | 7/1969 | Yamazaki et al. | 149/21 |
| 3,660,183 | 5/1972 | Knowles et al. | 149/21 |
| 3,765,334 | 10/1973 | Rentz et al. | 102/27 R |
| 3,876,477 | 4/1975 | Eldridge et al. | 149/19.3 |
| 3,921,394 | 11/1975 | Tannenbaum | 60/217 |
| 3,924,405 | 12/1975 | Cohen et al. | 60/219 |
| 4,023,994 | 5/1977 | Arendale | 149/19.2 |
| 4,057,441 | 11/1977 | Biddle | 149/19.9 |
| 4,072,546 | 2/1978 | Winer | 149/19.8 |
| 4,084,992 | 4/1978 | Hightower et al. | 149/17 |
| 4,108,696 | 8/1978 | Ashmore et al. | 149/19.2 |
| 4,140,561 | 2/1979 | Keith et al. | 149/2 |
| 4,432,818 | 2/1984 | Givens | 149/22 |
| 4,536,235 | 8/1985 | Lelu et al. | 149/19.4 |
| 4,696,705 | 9/1987 | Hamilton | 149/21 |
| 4,698,108 | 10/1987 | Vega et al. | 149/2 |
| 4,756,251 | 7/1988 | Hightower, Jr. et al. | 102/289 |
| 4,756,778 | 7/1988 | Deitz et al. | 149/108.2 |
| 4,799,979 | 1/1989 | Baldi | 149/2 |
| 4,806,180 | 2/1989 | Goetz et al. | 149/5 |
| 4,903,604 | 2/1990 | Blewett et al. | 102/364 |
| 4,938,813 | 7/1990 | Eisele et al. | 149/19.1 |
| 4,956,029 | 9/1990 | Hagel et al. | 149/19.1 |
| 4,971,640 | 11/1990 | Chi | 149/19.9 |
| 5,098,771 | 3/1992 | Friend | 428/209 |
| 5,165,909 | 11/1992 | Tennent et al. | 423/447.3 |
| 5,171,560 | 12/1992 | Tennent | 423/447.3 |

OTHER PUBLICATIONS

C. W. Farriss, II et al., "Reduction of Electrical Resistivity in Rubber Composites by Adding Carbon Fibrils," *1991 Fall Meeting of the Ohio Section of the American Physical Society,* Oct. 11–12, 1991.

C. W. Farriss, II et al., "Effects of Carbon Fibrils on Electrical Resistivity of Polybutadiene Composites," *1993 Regular Meeting of the Division of High Polymer Physics of the American Physical Society,* Mar. 22–26, 1993.

C. W. Farriss, II et al., "Effects of Graphite Fibrils on Electrical Resistivity of Polybutadiene Composites," *1992 Fall Meeting of the Ohio Section of the American Physical Society,* Oct. 2–3, 1992.

*Primary Examiner*—Edward A. Miller

*Attorney, Agent, or Firm*—Ronald L. Lyons; Madson & Metcalf

[57] ABSTRACT

Conductive carbon fibrils are incorporated into energetic compositions to enhance the burn rate. The carbon fibrils are grown catalytically from carbon precursors and are substantially free of pyrolytically deposited thermal carbon. The fibrils generally have a length in the range from about 1μ to about 10μ and a diameter in the range from about 3.5 nanometers to about 75 nanometers. Length to diameter aspect ratios are greater than 5, and typically in the range from about 100:1 to about 1000:1. A 100% improvement in burn rate was observed in compositions containing as little as 0.1 weight percent carbon fibrils. Greater amounts of carbon fibrils (2 weight percent) have increased the burn rate 500%. In most cases, fibril concentration will be in the range from about 0.1 to about 2 weight percent, although greater amounts are possible. The burn rate may be effectively tailored by varying the amount of fibrils added to the composition.

16 Claims, No Drawings

USE OF CARBON FIBRILS TO ENHANCE BURN RATE OF PYROTECHNICS AND GAS GENERANTS

BACKGROUND OF THE INVENTION

1. Field of the Invention

This invention relates to energetic compositions such as propellants, decoy compositions, obscurants, illuminants, gun propellants, target markers, tracer munitions, and gas generants. More particularly, the invention is directed to compositions and methods for enhancing the burn rate of such energetic materials.

2. Technology Background

The burn rate of energetic compositions such as propellants, pyrotechnics, and gas generants is defined as the distance traveled per second by the flame front perpendicularly to the exposed surface of the energetic material. The burn rate is dependent upon the pressure of the surrounding gas phase. The relationship may be expressed $r=KP^n$, where r is the burn rate, K is a proportionality constant, P is the absolute pressure, and n is the pressure exponent.

Often it is desirable to tailor the burn rate to specific applications. Tailoring the burn rate of energetic compositions is important to the design of articles with specific burn times and mass flow outputs. For example, a pyrotechnic obscurant composition with a low burn rate may not produce enough smoke to provide the desired obscuration effect. If a propellant burn rate is too low, then the gas output or thrust may be insufficient. Similarly, if a gas generant's burn rate is low, then the gas output may be insufficient to inflate a supplemental restraint device. Visible light and infrared illuminant flares with a low burn rate may not provide sufficient illumination.

Some additives are known to enhance the burn rate of energetic compositions. For example, iron oxide and catocene are two commonly used burn rate accelerants. They are often used with energetic compositions that contain ammonium perchlorate as the oxidizing agent. However, these burn rate accelerants have disadvantages. For instance, catocene is known to increase the friction and impact sensitivity of the energetic composition. Iron oxide is generally only effective for ammonium perchlorate systems. Its usefulness is limited in other oxidizer systems.

From the foregoing, it will be appreciated that there remains a need in the art for methods for enhancing the burn rate of energetic compositions.

Such methods for enhancing the burn rate of energetic compositions are disclosed and claimed herein.

SUMMARY OF THE INVENTION

The present invention is directed to the use of highly conductive carbon fibrils in energetic compositions to increase the burn rate. The fibrils used in the present invention are different than conventional carbon fibers. The carbon fibrils used in the present invention are grown catalytically from carbon precursors at temperatures well below typical graphitizing temperatures (usually 2900° C.). As a result, the carbon fibrils used in the present invention are substantially free of pyrolytically deposited thermal carbon.

The catalytic synthesis of the carbon fibrils used herein creates ordered layers of graphitic carbon disposed substantially concentrically about an inner core region along the cylindrical axis of the fibril. The inner core region may be hollow, and it may contain amorphous carbon atoms.

The carbon fibrils used in the present invention are generally much smaller than the pyrolytically formed fibers of the prior art. The fibrils generally have a length in the range from about 1μ to about 10μ and a diameter in the range from about 3.5 nanometers to about 75 nanometers. Length to diameter aspect ratios in the range from about 100:1 to about 1000:1 are typical for the carbon fibrils used herein.

The amount of fibrils included in the energetic compositions may vary depending on the desired burn rate modification, the conductivity of the fibrils and the specific gas generant or pyrotechnic formulation. In most cases, fibril concentration will be in the range from about 0.1 to about 5 weight percent.

DETAILED DESCRIPTION OF THE INVENTION

The present invention is directed to the use of unique carbon fibrils in energetic compositions for increasing the burn rate. Typical energetic compositions used herein include infrared decoy compositions, obscurants, illuminants, gun propellants, target markers, tracer munitions, gas generant compositions, and the like. The carbon fibrils used in the present invention are to be distinguished from carbon or graphite fibers used in the prior art. Conventional carbon fibers are typically made by pyrolysis of continuous filaments of precursor organic polymers, such as cellulose or polyacrylonitrile, under carefully controlled conditions. Unlike prior art fibers, the carbon fibrils used in the present invention are grown catalytically from carbon precursors without the need for graphitizing temperatures (usually 2900° C.). Thus, the carbon fibrils used in the present invention are substantially free of pyrolytically deposited thermal carbon.

The fibrils preferably contain an inner core region surrounded by graphitic layers that are substantially parallel to the fibril axis. One aspect of substantial parallelism is that the projection of the graphite layers on the fibril axis extends for a relatively long distance in terms of the external diameter of the fibril (e.g., at least two fibril diameters, preferably at least five diameters). The inner core region of the fibril may be hollow, and it may contain carbon atoms which are less ordered (amorphous) than the carbon atoms forming the graphitic layers. The fibrils preferably have diameters between about 3.5 and about 75 nanometers and typically about 15 nanometers. The fibrils usually have a length from about 1μ to about 10μ. The length to diameter aspect ratio is at least 5, and preferably in the range from about 100:1 to about 1000:1.

Suitable carbon fibrils may be obtained from Hyperion Catalysis International, Inc., Massachusetts, which currently sells two grades of carbon fibrils: BN and CC. The CC fibrils are currently preferred. Such carbon fibrils are disclosed in U.S. Pat. Nos. 5,171,560, 5,165,909, 5,098,771, and 4,663,230, which patents are incorporated herein by reference.

Small amounts of the highly-conductive fibrils are incorporated into energetic compositions to increase burn rate. The actual burn rate increase observed will vary from composition to composition. But generally, the burn rate increase will be at least about 20%. In some cases, the burn rate increase will exceed 500%. It has been observed that energetic compositions that contain an organic oxidizer or an organic fuel tend to experience a greater burn rate increase. In most cases, the fibrils are included in the energetic compositions in the range from about 0.1 to about 2 weight percent, and preferably at least about 0.5 weight percent.

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

EXAMPLE 1

Two pyrotechnic flare compositions where prepared containing the following ingredients:

| Ingredient | Comp. 1A Weight % | Comp. 1B Weight % |
|---|---|---|
| Magnesium | 65 | 63 |
| PTFE (<35μ) | 9 | 9 |
| PTFE (300–500μ) | 10 | 10 |
| Viton A ® | 16 | 16 |
| CC Carbon Fibrils | | 2 |

The magnesium had a −200/+325 mesh particle size. The PTFE (polytetrafluoroethylene), commonly referred to as "Teflon," possessed a bimodal particle size distribution as stated above. The Viton A®, a fluorinated ethylene propylene copolymer sold by DuPont, was in an acetone solution (30 weight percent Viton A®). The CC carbon fibrils were obtained from Hyperion Catalysis International, Inc., Massachusetts. The ingredients were mixed according to conventional pyrotechnic mixing procedures.

The burn rate of compositions 1A and 1B were measured. Composition 1A had a burn rate of 0.274 inches/second (ips) at ambient pressure, and composition 1B had a burn rate of 0.306 ips at ambient pressure.

EXAMPLE 2

Two pyrotechnic flare compositions were prepared containing the following ingredients:

| Ingredient | Comp. 2A Weight % | Comp. 2B Weight % |
|---|---|---|
| Magnesium | 47.0 | 45.0 |
| Ammonium Perchlorate | 20.0 | 20.0 |
| PTFE | 8.2 | 8.2 |
| Carbon (Coke Graphite) | 10.0 | 10.0 |
| HTPB | 12.0 | 12.0 |
| IPDI | 1.0 | 1.0 |
| Krytox ® | 1.8 | 1.8 |
| CC Carbon Fibrils | | 2.0 |

The magnesium had a −200/+325 mesh particle size. The ammonium perchlorate had a particle size of 20μ. The PTFE had a particle size of 100μ. The carbon was powdered graphite having a particle size of about 4μ. The HTPB was propellant grade hydroxy-terminated polybutadiene obtained from Atochem under the tradename, R-45M. The term "IPDI" refers to isophorone diisocyanate. Krytox® is a fluorinated plasticizer obtained from DuPont. The ingredients were mixed according to conventional pyrotechnic mixing procedures.

The burn rate of compositions 2A and 2B were measured. Composition 2A had a burn rate of 0.060 ips at ambient pressure, and composition 2B had a burn rate of 0.088 ips at ambient pressure.

EXAMPLE 3

Two pyrotechnic smoke compositions were prepared containing the following ingredients:

| Ingredient | Comp. 3A Weight % | Comp. 3B Weight % |
|---|---|---|
| Terephthalic acid | 50.0 | 48.0 |
| $KClO_3$ | 24.0 | 24.0 |
| $MgCO_3$ | 2.0 | 2.0 |
| Witco 1780 | 19.7 | 19.7 |
| ERL 0510 | 4.2 | 4.2 |
| Iron Linoleate | 0.1 | 0.1 |
| CC Carbon Fibrils | | 2.0 |

Witco 1780 is carboxy terminated triethyleneglycol succinate. ERL 0510 is a trifunctional epoxy resin curative which reacts with the carboxy functional groups of the Witco 1780. Iron linoleate is a cure catalyst added to accelerate the cure time. The ingredients were mixed according to conventional pyrotechnic mixing procedures.

The burn rate of compositions 3A and 3B were measured. Composition 3A had a burn rate of 0.024 ips at ambient pressure, and composition 3B had a burn rate of 0.035 ips at ambient pressure.

EXAMPLE 4

Six pyrotechnic compositions were prepared containing the following ingredients:

| Ingredient | 4A Wt % | 4B Wt % | 4C Wt % | 4D Wt % | 4E Wt % | 4F Wt % |
|---|---|---|---|---|---|---|
| $KNO_3$ (20μ) | 35.0 | 34.0 | 34.6 | 34.8 | 35.0 | 34.6 |
| $CsNO_3$ (250μ) | 35.0 | 34.0 | 34.6 | 34.8 | 35.0 | 34.6 |
| Silicon | 10.0 | 10.0 | 9.9 | 10.0 | 10.0 | 9.9 |
| Witco 1780 | 16.4 | 16.4 | 16.3 | 16.3 | 16.3 | 16.2 |
| ERL 0510 | 3.5 | 3.5 | 3.5 | 3.5 | 3.5 | 3.5 |
| Iron Linoleate | 0.1 | 0.1 | 0.1 | 0.1 | 0.1 | 0.1 |
| CC Fibrils | | 2.0 | 1.0 | 0.5 | 0.1 | |
| Graphite | | | | | | 1.0 |

The silicon included in the composition was elemental, amorphous powdered silicon having a particle size of about 5μ. The graphite was powdered graphite having a particle size less than 4μ. The ingredients were mixed according to conventional pyrotechnic mixing procedures.

The burn rate of compositions 4A through 4F were measured. The measured burn rates are reported below:

| Composition | Burn Rate | Burn Rate Increase | Carbon Fibril Wt % |
|---|---|---|---|
| 4A | 0.017 ips | — | — |
| 4B | 0.102 ips | 500% | 2.0 |
| 4C | 0.076 ips | 350% | 1.0 |
| 4D | 0.057 ips | 235% | 0.5 |
| 4E | 0.034 ips | 100% | 0.1 |
| 4F | 0.022 ips | 30% | 1.0† |

†Conventional graphite.

The results of Example 4 show that even small amounts of carbon fibrils can increase the burn rate substantially. For instance, 2.0 weight percent carbon fibrils increased the burn rate about 500%. The burn rate was also significantly increased upon addition of lesser amount of carbon fibrils. This demonstrates that the burn rate can be effectively tailored.

Because the carbon fibrils used herein and graphite are both composed of elemental carbon, it was postulated that carbon alone may be responsible for the observed burn rate increase. Therefore, formulation 4F was prepared containing 1 weight percent graphitized carbon. The graphite loaded formulation resulted in a burn rate increase of about 30% over the baseline formulation. Whereas, the analogous formulation loaded with 1% carbon fibrils resulted in a burn rate increase of 350%. These data demonstrate that the carbon fibrils are effective burn rate enhancers.

EXAMPLE 5

Two pyrotechnic compositions were prepared containing the following ingredients:

| Ingredient | Comp. 5A Weight % | Comp. 5B Weight % |
|---|---|---|
| $KNO_3$ (20μ) | 59.0 | 58.9 |
| $CsNO_3$ (50μ) | 10.0 | 10.0 |
| Silicon | 7.0 | 7.0 |
| Hexamine (granular) | 16.0 | 16.0 |
| Boron | 2.0 | 2.0 |
| Witco 1780 | 4.92 | 4.92 |
| ERL 0510 | 1.04 | 1.04 |
| Iron Linoleate | 0.04 | 0.04 |
| CC Carbon Fibrils | | 0.5 |

The ingredients were mixed according to conventional pyrotechnic mixing procedures.

The burn rate of compositions 5A and 5B were measured. Composition 5A had a burn rate of 0.0460 ips at ambient pressure, and composition 5B had a burn rate of 0.0797 ips at ambient pressure.

From the foregoing it will be appreciated that the present invention provides energetic compositions having enhanced burn rate. The present invention further provides methods for tailoring the burn rate of energetic compositions by incorporating carbon fibrils into the compositions.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for enhancing the burn rate in an energetic composition selected from propellant and pyrotechnic energetic compositions comprising incorporating into said energetic composition an effective quantity of conductive carbon fibrils sufficient to increase the burn rate at least 20% upon burning said energetic composition, said carbon fibrils having substantially continuous layers of ordered carbon atoms having an outside diameter between about 3.5 and 75 nanometers which are catalytically grown and having a distinct inner core region, each of the carbon layers being disposed substantially concentrically about the inner core region, wherein the fibrils are substantially free of pyrolytically deposited thermal carbon.

2. A method for enhancing the burn rate as defined in claim 1, wherein the carbon fibrils are incorporated into the energetic composition in the range from about 0.1 weight percent to about 2 weight percent.

3. A method for enhancing the burn rate as defined in claim 1, wherein the carbon fibrils have a length in the range from about 1μ to about 10μ.

4. A method for enhancing the burn rate as defined in claim 1, wherein the inner core region is hollow.

5. A method for enhancing the burn rate as defined in claim 1, wherein the inner core region contains amorphous carbon atoms.

6. A method for enhancing the burn rate as defined in claim 1, wherein the energetic composition is a pyrotechnic composition.

7. A method for enhancing the burn rate as defined in claim 6, wherein the pyrotechnic composition includes a binder.

8. A method for enhancing the burn rate as defined in claim 6, wherein the pyrotechnic composition does not include a binder.

9. A method for enhancing the burn rate as defined in claim 1, wherein the energetic composition is a pyrotechnic infrared decoy composition.

10. A method for enhancing the burn rate as defined in claim 1, wherein the energetic composition is a obscurant composition.

11. A method for enhancing the burn rate as defined in claim 1, wherein the energetic composition is a pyrotechnic illuminant composition.

12. A method for enhancing the burn rate as defined in claim 1, wherein the energetic composition is a gun propellant composition.

13. A method for enhancing the burn rate as defined in claim 1, wherein the energetic composition is a target marker composition.

14. A method for enhancing the burn rate as defined in claim 1, wherein the energetic composition is a tracer munition composition.

15. A method for enhancing the burn rate as defined in claim 1, wherein the energetic composition is a gas generant composition.

16. A method for enhancing the burn rate in propellants and pyrotechnics compositions comprising the steps of:

(a) obtaining an energetic composition selected from the group consisting of propellants and pyrotechnics, wherein the energetic composition contains from about 0.1 to about 2 weight percent conductive carbon fibrils having substantially continuous layers of ordered carbon atoms having an outside diameter in the range from about 3.5 nanometers to about 75 nanometers which are catalytically grown and having a distinct inner core region, each of the carbon layers being disposed substantially concentrically about the inner core region, wherein the carbon fibrils are catalytically grown and substantially free of pyrolytically deposited thermal carbon and wherein the carbon fibrils have a length in the range from about 1μ to about 10μ; and (b) burning the energetic composition such that the burn rate of the energetic composition is increased at least 20% compared to the energetic composition without said carbon fibrils.

* * * * *